US006672536B2

(12) United States Patent
Bär et al.

(10) Patent No.: US 6,672,536 B2
(45) Date of Patent: Jan. 6, 2004

(54) BRAKING ARRANGEMENT FOR A CORRECTABLE-TRAJECTORY SPIN-STABILIZED ARTILLERY PROJECTILE

(75) Inventors: Klaus Bär, Lauf (DE); Jürgen Bohl, Eckenhaid (DE)

(73) Assignee: Diehl Munitionssysteme GmbH & Co. KG, Rothenbach (DE)

( * ) Notice: Subject to any disclaimer, the term of this patent is extended or adjusted under 35 U.S.C. 154(b) by 0 days.

(21) Appl. No.: 10/230,524

(22) Filed: Aug. 29, 2002

(65) Prior Publication Data

US 2003/0042356 A1 Mar. 6, 2003

(30) Foreign Application Priority Data

Sep. 4, 2001 (DE) ..... 101 43 312

(51) Int. Cl.[7] ..... F42B 10/50; F42B 10/14

(52) U.S. Cl. ..... 244/3.27; 244/3.23; 244/3.26; 244/3.27; 244/3.29

(58) Field of Search ..... 244/3.23, 3.21, 244/3.24, 3.28, 3.29; 102/385, 388

(56) References Cited

U.S. PATENT DOCUMENTS

| | | | | | |
|---|---|---|---|---|---|
| 2,666,387 | A | * | 1/1954 | Richey | 102/385 |
| 3,047,259 | A | * | 7/1962 | Tatnall | 244/138 A |
| 4,565,340 | A | * | 1/1986 | Bains | 244/3.28 |
| 4,699,333 | A | * | 10/1987 | Pinson | 244/3.21 |
| 4,869,442 | A | * | 9/1989 | Miller | 244/3.28 |
| 6,250,584 | B1 | * | 6/2001 | Hsu et al. | 244/3.24 |
| 6,349,652 | B1 | * | 2/2002 | Hepner et al. | 102/519 |
| 6,454,205 | B2 | * | 9/2002 | Niemeyer et al. | 244/3.26 |
| 6,511,016 | B2 | * | 1/2003 | Bar et al. | 244/3.24 |
| 6,588,700 | B2 | * | 7/2003 | Moore et al. | 244/3.28 |
| 2001/0039898 | A1 | * | 11/2001 | Bar et al. | 102/501 |
| 2003/0042356 | A1 | * | 3/2003 | Bar et al. | 244/3.23 |

FOREIGN PATENT DOCUMENTS

| | | | | |
|---|---|---|---|---|
| DE | 81401 | | 9/1920 | |
| DE | 198 24 288 | A1 | 12/1999 | |
| EP | 1087201 | A1 * | 3/2001 | F42B/10/62 |
| FR | 2658600 | * | 2/1990 | F42B/8/22 |
| GB | 2337804 | A * | 12/1999 | F41G/7/00 |
| WO | WO 02/14780 | A1 * | 2/2002 | F42B/10/50 |

* cited by examiner

*Primary Examiner*—Charles T. Jordan
*Assistant Examiner*—Stephen Holzen
(74) *Attorney, Agent, or Firm*—Scully, Scott, Murphy & Presser

(57) ABSTRACT

In order to provide that the braking elements (16), which are to be deployed radially under the effect of centrifugal force, of the braking arrangement in the region of the ogival head of a spin-stabilized artillery projectile (12) are secured in the rest position and can then be released in a defined manner when reaching the braking point of the ballistic trajectory, the stowage space (14) for accommodating the braking elements (16) is radially covered by a hood (22) which is fitted on to the projectile fuse (11) in the afflux direction and is axially fixed between a recess (24) in the rear wall (25) of the stowage space and a front-end holding ring (26) connected to the ogival head. To release the braking elements (16) the more solid front annular region (28) of the hood (22) is blown off radially by means of pyrotechnic force elements (19) and therewith the hollow-frustoconical hood wall is broken open rearwardly, over the stowage space (14), along desired-rupture locations, to form shell portions which are approximately parallel to the axis and which are then firstly pivoted outwardly in a rotational movement hinge-like in the recess (24) by the afflux flow and are finally flung away. In that way the solid or textile braking elements (16) which are fitted into the stowage space (14) can now be deployed out of the stowage space 14 into their radial operative position under the effect of centrifugal force, pivoting about their pivotal mounting to a ring (15) in the front region of the stowage space (14).

9 Claims, 1 Drawing Sheet

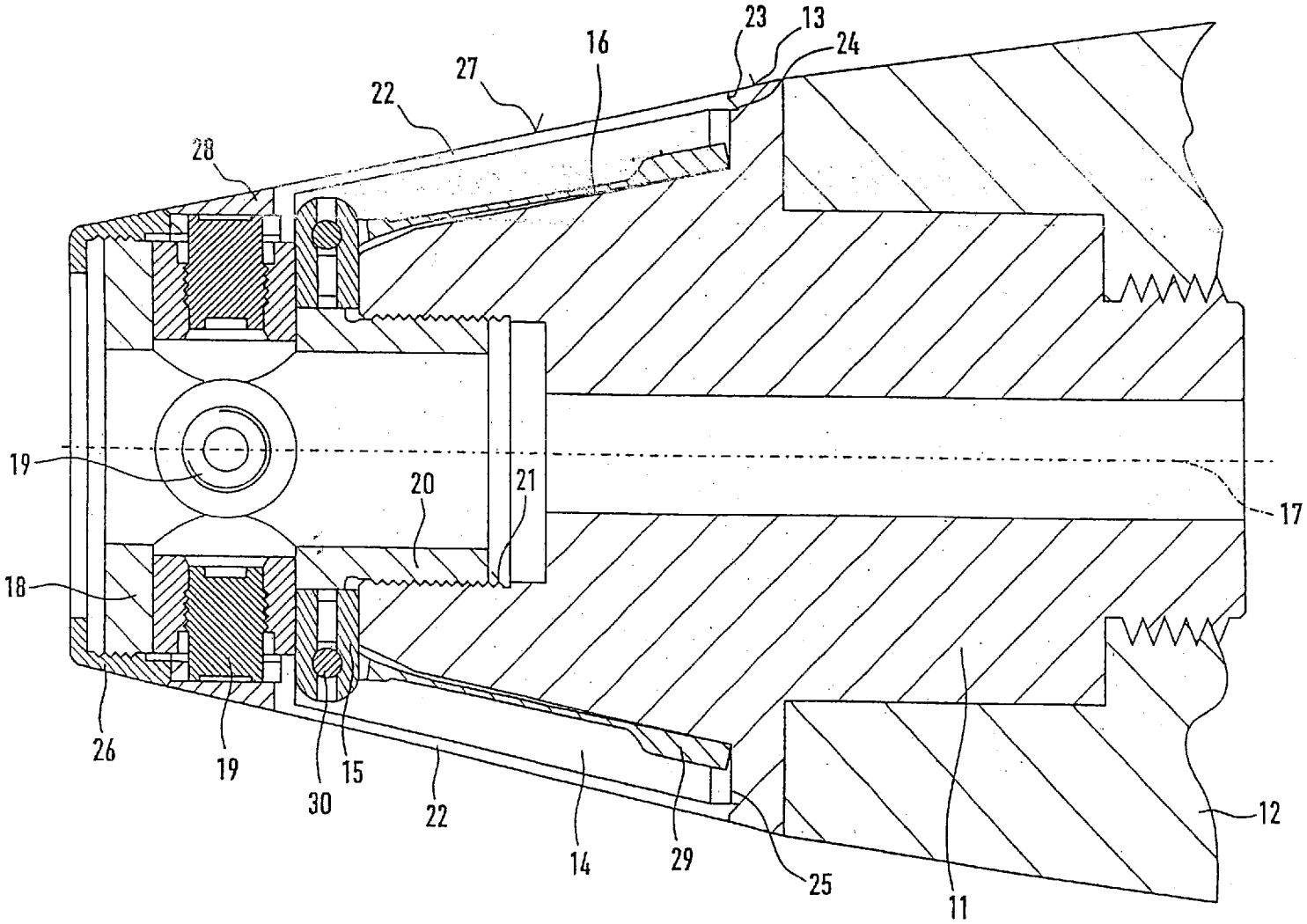
17
12
11
24
13
23
25
29
16
14
21
27
22
20
22
15
30
28
19
26
19
18

BRAKING ARRANGEMENT FOR A CORRECTABLE-TRAJECTORY SPIN-STABILIZED ARTILLERY PROJECTILE

BACKGROUND OF INVENTION

1. Field of the Invention

The invention concerns a braking arrangement comprising braking elements which are held in the fuse region of an ogival head of a correctable-trajectory spin-stabilized artillery projectile located under a head; and which can be deployed from a storage space.

2. Discussion of the Prior Art

A braking arrangement of that kind is subject-matter of DE 100 23 345.7 of May 12, 2000, which is not a prior publication. The arrangement described therein serves for deliberately shortening the ballistic trajectory in order to reduce lengthwise scatter in relation to the predetermined target co-ordinates and thereby to enhance the effectiveness of munition deployment, as described in greater detail in EP 1 103 779 A1.

SUMMARY OF THE INVENTION

The object of the present invention is to develop a braking arrangement of the general kind set forth, in such a way that the braking elements are extended as precisely as possible.

In accordance with the invention that object is attained by the combination of the essential features, which is recited in the main claim. In accordance therewith a holding hood for the braking elements when they have not yet been moved into the operative position extends forwardly in the axial direction towards the tip of the projectile beyond the stowage space for the braking elements and the pivot mounting thereof to the conically tapered fuse region in which are arranged force elements which act radially from the inside against the hood in order to blow off the hood at the braking triggering point on the trajectory with the hood breaking open in the form of shell portions to release the braking elements.

The force elements are preferably electrically initiatable pyrotechnic charges which are activated by means of a control circuit when, on the descending shallow branch of the hitherto ballistic trajectory, the trajectory point is reached from which flight braking with a correspondingly steeper descent leads to a more accurate impact location in the target area.

In regard to desirable developments and structural details and the advantages thereof, besides the further claims, attention is also directed to the description hereinafter of a preferred embodiment of the structure according to the invention which is shown diagrammatically approximately true to scale in abstracted form being limited to what is essential in the drawing.

BRIEF DESCRIPTION OF THE ACCOMPANYING DRAWINGS

The single FIGURE of the drawing is a broken-away view in axial longitudinal section of a fuse with an integrated braking arrangement in accordance with a configuration of the invention in the region of the ogival head of an artillery projectile.

DETAILED DESCRIPTION OF A PREFERRED EMBODIMENT

A fuse 11 which is designed to be screwed into the ogival head of an artillery projectile 12 has, in its frustoconical peripheral surface 13, a stowage space 14 which is arranged in peripherally extending radially recessed relationship. In axially opposite relationship to its rear wall 25, that is to say in the direction of flight, the stowage space 14 is delimited by a ring 15 which is fitted here and to which braking elements 16 are pivotably mounted. In their rest position they remain in the stowage space 14 from which they can be pivoted out into their operative position, more specifically into an orientation which is substantially radial with respect to the longitudinal axis 17 of the projectile. So that the Coriolis force which occurs upon rotation of the projectile 12 in the outward pivotal movement of the braking elements in the pivotal mounting region can be reduced, it is desirable to initially allow the ring 15 slippage somewhat in its position, relative to the rotating projectile 12.

In this embodiment a mushroom-shaped mounting 18 for a plurality of (at least two; four are diagrammatically shown in the drawing) peripherally mutually displaced, radially acting pyrotechnic force elements 19 engages with its hollow shank 20 from the front through the pivotal mounting ring 15 into a receiving bore 21 in the fuse 11.

A hollow-frustoconical cover or hood 22 which with its outside peripheral surface 27 completes the contour of the tapering peripheral surface 13 of the ogival head over the stowage space 14 is fitted in the afflux direction, that is to say from the tip of the fuse 11, over the mushroom-shaped mounting 18 with the force elements 19. In axially opposite relationship to the mounting 18, the free end edge 23 of the large-area base of the hood 22 engages into a peripherally extending recess 24 which is cut into the rear wall 25 of the stowage space 14 closely under the peripheral surface 13 in parallel relationship with the axis. That axial engagement is secured by an aerodynamically configured holding ring 26 which is screwed or connected in some other fashion to the mounting 18, in front of the front smaller end face of the hood 22. The aerodynamic geometry of the ogival head of the projectile with the peripheral surface 13 of the fuse is thus continued by way of the hood 22 to the holding ring 26.

At the front, behind its small base, the hood 22 is in the form of an annular region 28 of relatively massively profiled cross-section, which bears radially against the mounting 18. Adjoining same, in one piece therewith, in a rearward direction, until it engages into the recess 24, is a hollow-frustoconical wall which in contrast is very thin. That thin-walled region is structurally designed to break up along separation or desired-rupture locations into individual shell portions which then lift radially away from the stowage space 14. For that purpose, separation locations which extend along generatrices of the outer peripheral surface 27 of the hood 22 are slotted from the rearward end wall 23 into the proximity of the annular region 28, or are at any event weakened structurally to form desired-rupture locations which extend substantially parallel to the axis.

The force elements 19 can be installed in the mounting 18 in themselves in any orientation. In principle, it is sufficient for just one force element 19 to be installed and for the reaction gas vapours thereof to be directed against the annular region 28 which is to be broken open, by way of direction-changing or diversion passages, directly or by means of pistons which are to be displaced thereby. The only important consideration is that the reaction gas vapours act with decisive radial components from the inside against the annular region 28 of the hood 22 in order to break it open quickly and therearound, as simultaneously as possible; in that respect however tests have shown that such simultaneity is not functionally critical because the annular region 28 is immediately torn off therearound by the afflux flow once it has just been broken open at one location. At any event, when the pyrotechnic force elements 19 (referred to as squibs) are initiated, the radial loading results in the annular region 28 and therewith also the separation locations in the thinner wall portion of the hood 22 being broken open. When the fragments of the annular region 28 are radially blown off, the individual wall portions which are broken open to form longitudinal shell portions are pivoted radially outwardly against the afflux flow caused by flight of the projectile, about their hinge-like engagement into the recess 24, and are flung radially away by the afflux flow. In order to promote that hinge-like pivotal movement in the recess 24, the recess 24, as shown in the drawing, like also the end edge 23 engaging therein, are of a triangular cross-section. At the front end, possible jamming of the fragments of the annular region 28, which are to be radially blown off, with the holding ring 26 which bears thereagainst axially in front of same, is advantageously avoided by the annular radial contact surface being bevelled to open forwardly in a funnel-shaped configuration, as shown in the drawing. That ensures that, in the course of being blown radially off, the annular region 28 comes unimpededly free from the axially adjacent surface of the holding ring 26.

By the hood 22 being broken open in the form of shell portions in that way and lifted out of the stowage space 14, the braking elements 16 are released to be pivoted outwardly from the stowage space 14 into a substantially radially operative position, about their respective pivotal mounting to the ring 15, under the action of the centrifugal force of the spin-stabilised artillery projectile 12. That centrifugal force-induced deployment is promoted by virtue of the fact that—in opposite relationship to the pivotal mounting to the ring 15—the free ends of the braking elements 16 are provided with a mass accumulation portion 29 in order to increase the moment of inertia for stable deployment into a position which is as radial as possible and which, for affording the maximum braking action, gives the largest area for the afflux flow.

As illustrated, the braking elements 16 can involve segmented flaps which are pivotably mounted to pivot shafts 30 which in turn are fixed to the ring 15 along secants; or the braking elements 16 involve textile members which are folded into the stowage space 14 and which are provided with additional weights in their outer regions and which are in the form of a plurality of strips or a closed cloth which is in the form of a circular ring, such members being pivoted directly to the ring 15 by being sewn therearound. That annular cloth is preferably reinforced by radially extending sewn-on portions, wherein the mass accumulations are sewn in position between the outer ends of the sewn-on portions, which are disposed opposite to the pivotal mountings to the ring 15, along the outer periphery of the braking cloth.

The pivotal mountings to the ring 15 preferably involve frictional engagement in order as far as possible to avoid mechanical loading peaks at the pivotal mounting, upon deployment of the braking elements 16 against the afflux flow, as a consequence of movements which are subjected to a braking effect. In order also to avoid mechanical overloadings, the braking elements 16 when released do not strike against a structural abutment, but they assume in a freely swinging condition the stable position which is governed by the afflux flow and centrifugal force and in which, in the case of braking flaps, they can then finally also experience a mechanical locking effect. The pivotal mounting is disposed as far forwardly as possible in the tapering region of the ogival head because there the annular surface of the braking elements 16 which are deployed substantially radially outwardly is relatively greater and thus affords a better braking action than a pivotal mounting at the larger diameter of the ogival head.

In order therefore to provide that the braking elements 16, which are to be deployed radially under the effect of centrifugal force, of the braking arrangement in the region of the ogival head of a spin-stabilised artillery projectile 12 are secured in the rest position in the stowage space and can then be released in a defined manner when reaching the braking point of the ballistic trajectory, the stowage space 14 for accommodating the braking elements 16 is radially covered by a hood 22 which, in accordance with the invention, is fitted on to the projectile fuse 11 in the afflux direction and is axially fixed between a recess 24 in the rear wall 25 of the stowage space and a front-end holding ring 26 connected to the ogival head. To release the braking elements 16 the more solid front annular region 28 of the hood 22 is blown off radially by means of pyrotechnic force elements 19 and therewith the hollow-frustoconical hood wall is broken open rearwardly, over the stowage space 14, along desired-rupture locations, to form shell portions which are approximately parallel to the axis and which are then firstly pivoted outwardly in a rotational movement hinge-like in the recess 24 by the afflux flow and are finally flung away substantially radially in a rearward direction. In that way the solid or textile braking elements 16 which are fitted into the stowage space 14 can now be deployed with their free ends out of the stowage space 14 into their radial operative position under the effect of centrifugal force, pivoting about their pivotal mounting to a ring 15 in the front region of the stowage space 14.

What is claimed is:

1. A braking arrangement including braking elements (16) which are held in a fuse region of an ogival head of a correctable-trajectory spin-stabilised artillery projectile (12) under a hood (22) and which are radially deployable from a stowage space (14), said hood (22) having a front annular region (28) which is more solid in comparison with a thin, rearwardly opening, hollow-frustoconical wall, and extending axially to a position of radially bearing against a mounting (18) for at least one force element (19) which is designed to impart a radial bursting effect against the interior of an annular region (28) of the hood (22).

2. A braking arrangement according to claim 1 wherein said hood (22), for braking open into shell portions which are substantially parallel to the axis, is provided in the region of the stowage space (14) with separation locations which extend substantially parallel to the longitudinal axis of said projectile and which are in the form of slots or specified-rupture locations.

3. A braking arrangement according to claim 1, wherein said hood (22), in opposite relationship to the front annular region (28), engages with a rearward end edge (23) thereof, in substantially parallel relationship with the longitudinal axis of said projectile, pivotably into a recess (24) in a rear wall (25) of the stowage space (14).

4. A braking arrangement according to claim 1, wherein said hood (22) is fixed axially in front of the annular region (28) by means of a holding ring (26).

5. A braking arrangement according to claim 4, wherein an annular contact surface between the holding ring (26) and the annular region (28) of the hood is beveled to open forwardly in a funnel configuration with respect to the radial plane for the annular region (28) which is blown open radially to redialy lift away therefrom.

6. A braking arrangement according to claim 1, wherein a ring (15) projects into the front region of the stowage space (14), the braking elements (16) being pivotably mounted to the ring directly or by way of secant shafts.

7. A braking arrangement according to claim 1, wherein said braking elements (16) are flaps or tongue portions which, in opposite relationship to pivotal mountings thereof are equipped at their free ends with mass accumulation portions (29).

8. A braking arrangement according to claim 1, wherein the braking elements (16) are integrated to form an annular disc which are flexibly foldable into the stowage space (14) and which has a mass accumulation portion (29) disposed along the outside edge of the disc.

9. A braking arrangement according to claim 1, wherein the deployment movement of the braking elements (16) is effected in a structurally damped manner against an oncoming flow of air.

* * * * *